US011313065B2

(12) United States Patent
Lee et al.

(10) Patent No.: US 11,313,065 B2
(45) Date of Patent: Apr. 26, 2022

(54) LAUNDRY TREATMENT APPARATUS

(71) Applicant: LG Electronics Inc., Seoul (KR)

(72) Inventors: Jihong Lee, Seoul (KR); Wooseong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 8 days.

(21) Appl. No.: 17/071,443

(22) Filed: Oct. 15, 2020

(65) Prior Publication Data

US 2021/0108354 A1 Apr. 15, 2021

(30) Foreign Application Priority Data

Oct. 15, 2019 (KR) ..... 10-2019-0127713

(51) Int. Cl.

| | |
|---|---|
| ***D06F 37/28*** | (2006.01) |
| ***D06F 21/08*** | (2006.01) |
| ***D06F 37/30*** | (2020.01) |
| ***D06F 37/24*** | (2006.01) |

(52) U.S. Cl.

CPC ..... *D06F 37/28* (2013.01); *D06F 21/08* (2013.01); *D06F 37/24* (2013.01); *D06F 37/304* (2013.01)

(58) Field of Classification Search

CPC ..... D06F 37/28

See application file for complete search history.

(56) References Cited

U.S. PATENT DOCUMENTS

2015/0376828 A1* 12/2015 Seo ..... D06F 29/00 68/3 R

* cited by examiner

*Primary Examiner* — Jason Y Ko

(74) *Attorney, Agent, or Firm* — Fish & Richardson P.C.

(57) ABSTRACT

The present application relates to a laundry treatment apparatus. The laundry treatment apparatus includes: a cabinet having a front panel and an opening provided by penetrating through the front panel; a drawer body configured to be ejected from the cabinet through the opening of the cabinet; a tub provided in the drawer body and defining a space configured to receive water; a drum rotatably provided in the tub and configured to receive laundry; a drawer panel fixed to the drawer body and configured to open the opening of the cabinet when the drawer body is ejected from the cabinet and to close the opening of the cabinet when the drawer body is retracted into the cabinet; and a drawer holder configured to fasten the drawer panel to the cabinet when the drawer panel closes the opening of the cabinet.

14 Claims, 6 Drawing Sheets

LAUNDRY TREATMENT APPARATUS

CROSS REFERENCE TO RELATED APPLICATION

The present application claims the benefit of priority to Korean Application No. 10-2019-0127713, filed on Oct. 15, 2019, the disclosures of which are incorporated by reference in their entirety.

TECHNICAL FIELD

The present disclosure relates generally to a laundry treatment apparatus.

BACKGROUND

In general, a laundry treatment apparatus includes a washing machine for clothing (object to be washed or dried), a drying machine for clothing, and a washing machine having both washing and drying functions.

Among conventional laundry treatment apparatuses, one type of laundry treatment apparatus includes a cabinet, a drawer provided to be ejected from the cabinet, a tub provided in the drawer and in which water is stored, a drum rotatably provided in the tub and in which laundry is stored, and a driving part rotating the drum.

In the case of the laundry treatment apparatus having the above structure, when the drum is rotated for treating laundry, vibration occurs in the drawer, and the vibration of the drawer causes a problem that the drawer is ejected from the inside of the cabinet during rotation of the drum.

SUMMARY

Accordingly, the present disclosure has been made keeping in mind the above problems occurring in the related art, and the present disclosure is intended to propose a laundry treatment apparatus having a drawer holder that minimizes vibration of a drawer in a cabinet during a laundry washing process or a laundry drying process.

Another objective of the present disclosure is to provide a laundry treatment apparatus having a drawer holder that prevents a drawer from being ejected from a cabinet during a laundry washing process or a laundry drying process.

Further objective of the present disclosure is to provide a laundry treatment apparatus having a drawer holder with excellent durability.

In order to achieve the above objectives, according to one aspect of the present disclosure, there is provided a laundry treatment apparatus including: a cabinet comprising a front panel and an opening provided by penetrating through the front panel; a drawer body configured to be ejected from and retracted into the cabinet through the opening of the cabinet; a tub provided in the drawer body and defining a space configured to receive water; a drum rotatably provided in the tub and configured to receive laundry; a drawer panel fixed to the drawer body and configured to open the opening of the cabinet when the drawer body is ejected from the cabinet and to close the opening of the cabinet when the drawer body is retracted into the cabinet; and a drawer holder configured to fasten the drawer panel to the cabinet when the drawer panel closes the opening of the cabinet.

The drawer holder may include: a fastening body protruding from the front panel toward the drawer panel; a panel through hole formed in a portion of the drawer panel, the portion facing the front panel, and into which the fastening body may be inserted; a receiving body fixed to the drawer panel and providing a space for receiving the fastening body inserted in the panel through hole; a cut portion extending from a free end of the receiving body toward the drawer panel and provided by penetrating through the receiving body, and dividing the receiving body into at least two boards that are separated from each other; and a board supporter limiting a motion range of each of the boards in a direction away from a center of the panel through hole.

A distance between the board supporter and each of the boards may be preset to be shorter than a displacement by which the board performs plastic deformation.

The board supporter may include a support body fixed to the drawer panel and covering the receiving body.

The laundry treatment apparatus may include: a reinforcing portion provided to connect an outer circumferential surface of the board to the support body to reinforce strength of the board.

The laundry treatment apparatus may include: a reinforcing portion provided to connect an outer circumferential surface of the board, the drawer panel, and the support body to each other, wherein a length from the drawer panel to a free end of the reinforcing portion may be preset to be shorter than a length from the drawer panel to a free end of the board.

A length from the drawer panel to a free end of the support body may be preset to be equal to or longer than a length from the drawer panel to the free end of the receiving body.

The length from the drawer panel to the free end of the support body may be preset to be longer than ½ of the length from the drawer panel to the free end of the receiving body.

The receiving body may be configured as one of a cylindrical shape with an empty inside, a conical shape with an empty inside, a polygonal pillar shape with an empty inside, and a polygonal pyramid shape with an empty inside.

The board supporter may include a ring-shaped support body removably locked to a circumferential surface of the receiving body.

A length from the drawer panel to a free end of the support body may be preset to be longer than a length from the drawer panel to an end of the cut portion.

The length from the drawer panel to the free end of the support body may be preset to be less than ½ of the length from the drawer panel to the free end of the receiving body.

The laundry treatment apparatus may include: a contact protrusion protruding from each of the boards toward an inside of the receiving body to be in contact with the fastening body.

The drawer holder may include: a first holder positioned on the cabinet at a left side of the opening; and a second holder positioned on the cabinet at a right side of the opening.

The laundry treatment apparatus may include: a tub entrance provided by penetrating through an upper surface of the tub; a drum entrance provided by penetrating through an upper surface of the drum; a stator fixed to a bottom surface of the tub and generating a rotating magnetic field; a rotor rotated by the rotating magnetic field; and a rotating shaft provided by penetrating through the bottom surface of the tub to connect the rotor to the drum, wherein the first holder and the second holder may be positioned below a horizontal line passing through a center of the opening of the cabinet.

The present disclosure provides a laundry treatment apparatus including: a cabinet comprising a front panel and an opening provided by penetrating through the front panel; a drawer body configured to be ejected from and retracted into the cabinet through the opening of the cabinet; a tub provided in the drawer body and defining a space configured to receive water; a drum rotatably provided in the tub and in which laundry is received; a drawer panel fixed to the drawer body and configured to open the opening of the cabinet when the drawer body is ejected from the cabinet and to close the opening of the cabinet when the drawer body is retracted into the cabinet; and a drawer holder locking the drawer panel to the cabinet when the drawer panel closes the opening of the cabinet.

The drawer holder may include: a fastening body protruding from the drawer panel toward the front panel; a panel through hole provided by penetrating through the front panel and into which the fastening body may be inserted; a receiving body fixed to the front panel and providing a space in which the fastening body inserted in the panel through hole may be received; a cut portion provided by penetrating through the receiving body, extending from a free end of the receiving body toward the front panel, and dividing the receiving body into at least two boards that may be separated from each other; and a board supporter limiting a motion range of each of the boards in a direction radially away from a center of the panel through hole.

A distance between the board supporter and each of the boards may be preset to be shorter than a displacement by which the board performs plastic deformation.

The present disclosure can provide the laundry treatment apparatus having the drawer holder that minimizes vibration of the drawer in the cabinet during a laundry washing process or a laundry drying process.

The present disclosure can provide the laundry treatment apparatus having the drawer holder that prevents the drawer from being ejected from the cabinet during a laundry washing process or a laundry drying process.

The present disclosure can provide the laundry treatment apparatus having the drawer holder with excellent durability.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
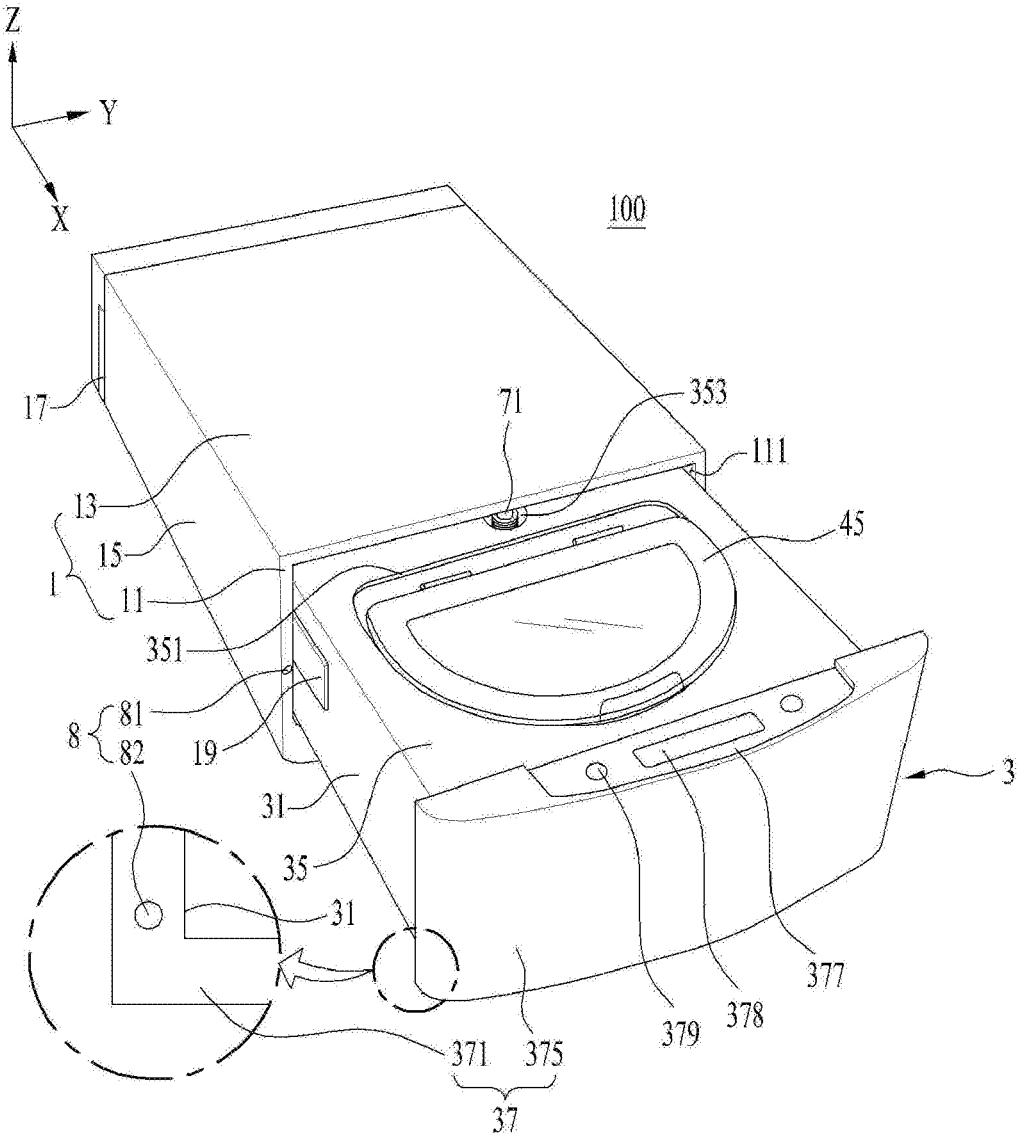
FIGS. 1 and 2 are views showing a laundry treatment apparatus according to an embodiment of the present disclosure.

Hereinbelow, exemplary embodiments of a laundry treatment apparatus 100 according to the present disclosure will be described with reference to the accompanying drawings. The configuration or control method of the apparatus to be described below is for describing embodiments of the laundry treatment apparatus 100, and is not intended to limit the scope of the present disclosure. The same reference numerals will be used throughout the description to refer to the same or like elements or parts.

As shown in FIG. 1, the laundry treatment apparatus 100 includes a cabinet 1 and a drawer 3 that may be ejected from the cabinet 1. The cabinet 1 may include a front panel 11 forming a front surface of the laundry treatment apparatus 100, an upper panel 13 forming an upper surface of the laundry treatment apparatus 100, side panels 15 forming side surfaces of the laundry treatment apparatus 100, and a rear panel 17 forming a rear surface of the laundry treatment apparatus 100.

The front panel 11 has an opening 111 that allows the inside of the cabinet to communicate with the outside thereof. The opening 111 may be a through hole provided by penetrating through the front panel 11 and having an area smaller than an area of the front panel 11.

The cabinet 1 is preferably has a length in a width direction thereof (Y-axis direction) formed longer than a length in a height direction thereof (Z-axis direction) (it is preferable that a length in a width direction of the drawer is formed longer than a length in a height direction thereof).

The drawer 3 may include a drawer body 31, a drawer cover 35, and a drawer panel 37. The drawer body 31 may be positioned in the cabinet 1 and be ejected from the cabinet 1 through the opening 111, the drawer cover 35 forming an upper surface of the drawer body 31, and the drawer panel 37 fixed to the drawer body 31 and closing the opening 111.

The drawer body 31 may be formed in a hexagonal shape with an open surface at an upper portion thereof, and the drawer cover 35 may be formed in a rectangular shape that closes the upper surface of the drawer body 31.

The drawer cover 35 may include a first through hole 351 and a second through hole 353. The first through hole 351 may be provided by penetrating through the drawer cover 35 and allow the inside of the drawer body 31 to communicate with the outside of the drawer body 31, and second through hole 353 may be provided by penetrating through the drawer cover 35 and in which a water pipe 71 to be described below may be inserted.

The drawer panel 37 may be provided to include a panel body 371 fixed to the drawer body 31 and a panel cover 375 removably coupled to the panel body. The panel body 371 may be fixed to the drawer body 31 and form a plane parallel to the front panel 11, and the panel cover 375 may be fixed to the panel body 371 to form a front surface of the drawer panel 37.

A control panel 377 controlling the operation of the laundry treatment apparatus 100 may be provided at an upper surface of the panel cover 375. The control panel 377 may include an input part 378 receiving control commands from a user, and a display part 379 (a part displaying operational information of the laundry treatment apparatus) displaying control commands selected by the input part 378, including user selectable control.

Figure 2:
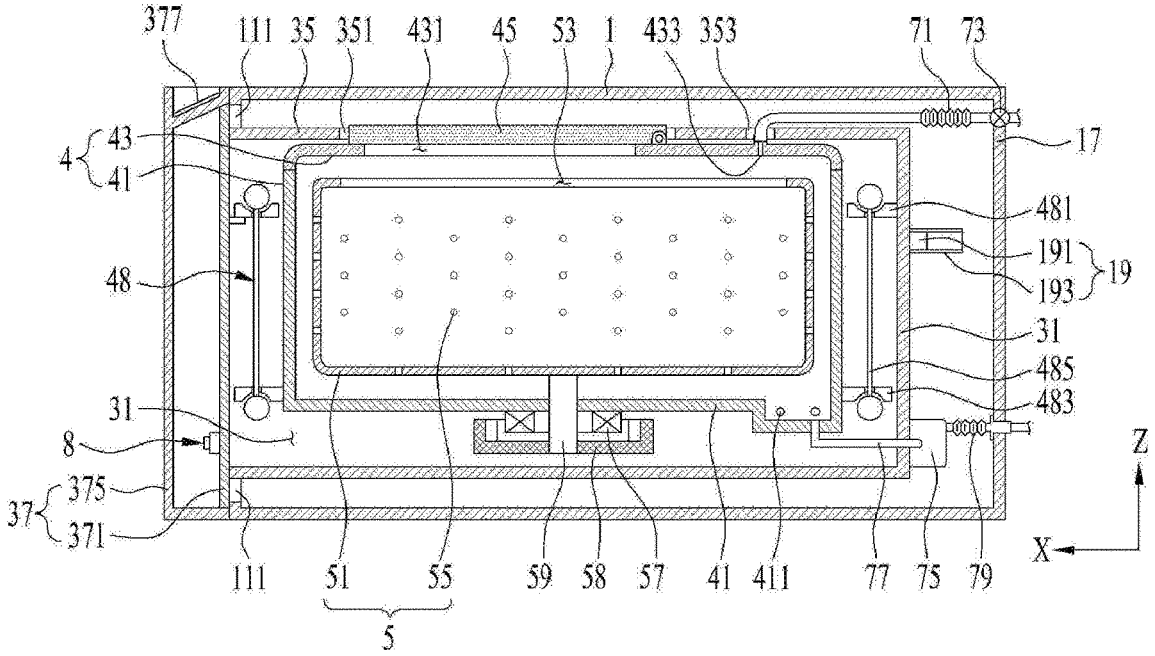

A slider 19 supporting the drawer 3 is provided in the cabinet 1. As shown in FIG. 2, the slider 19 may include a housing 191 fixed in the cabinet 1, and a slider body 193 in which a first end thereof is fixed to the drawer body 31 and a second end thereof is inserted in the housing 191.

The drawer body 31 has a laundry receiving part 4, 5 therein, and the laundry receiving part 4, 5 provides a laundry treatment space (washing or drying space). FIG. 2 is a view showing an embodiment of the laundry receiving part having a tub 4 and a drum 5.

The tub 4 is provided to include a tub body 41 and a tub cover 43. The tub body 41 is formed in a cylindrical shape with an empty inside to provide a space in which water is stored, and the tub cover 43 is fixed to the tub body 41 and forms an upper surface of the tub 4.

The tub body 41 is movably fixed in the drawer 3 by a tub supporter 48. The tub supporter 48 is a part connecting an outer circumferential surface of the tub body 41 to the drawer 3, and the tub supporter 48 may be provided to include a first bracket 481 provided in the drawer, a second bracket 483 provided in the outer circumferential surface of the tub body 41, and a supporting bar 485 having a first end supported by the first bracket and a second end supporting the second bracket.

The tub cover 43 includes a tub entrance 431 allowing the inside of the tub body 41 to communicate with the outside of the tub body 41, and a water inlet 433 supplying water into the tub body 41.

The tub entrance 431 is closed by a door 45 that is rotatably coupled to the tub cover 43. The tub entrance 431 is positioned below the first through hole 351 provided in the drawer cover 35. The door 45 may be rotated without interference with the drawer cover 35 through the first through hole 351. Accordingly, the user can eject the drawer 3 from the cabinet 1 and then rotate the door 45, thereby opening the tub entrance 431.

Through a water-supply part, the tub 4 is connected to a water source (not shown) positioned outside of the cabinet 1. The water-supply part may include the water pipe 71 connecting the water source (not shown) to the water inlet 433, and a valve 73 controlled to open and close the water pipe 71 by a controller.

Meanwhile, water stored in the tub 4 is discharged to the outside of the cabinet 1 through a discharge part. The discharge part may include a first drain pipe 77 guiding the water in the tub 4 to the outside of the cabinet 1, a pump 75 moving the water in the tub 4 to the first drain pipe 77, and a second drain pipe 79 guiding the water discharged from the pump to the outside of the cabinet 1.

The drum 5 is formed in a cylindrical shape with an empty inside, and includes a drum body 51 positioned in the tub 4 and a drum entrance 53 provided on an upper surface of the drum body 51. Drum through holes 55 are provided on a circumferential surface and a bottom surface of the drum body 51. Accordingly, the water stored in the tub body 41 may move into the drum body 51 through the drum through holes 55.

The drum body 51 may be rotated inside the tub 4 by a driving part provided outside the tub 4. The driving part may be provided to include a stator 57 fixed to a bottom surface of the tub body 41 and forming a rotating magnetic field, a rotor 58 rotated by the rotating magnetic field, and a rotating shaft 59 penetrate the bottom surface of the tub body 41 to connect the rotor 58 to the bottom surface of the drum body 51.

As shown in FIG. 2, the rotating shaft 59 may be provided perpendicular to the drum entrance 53 (the rotating shaft 59 may be provided perpendicular to a bottom surface of the drawer body).

The driving part is fixed to the tub body 41 and the tub body 41 is fixed to the drawer 3 through the tub supporter 48, so that the laundry treatment apparatus 100 having the structure described above may transmit vibration generated in the drum or the tub during the rotation of the rotor 58 to the drawer 3.

When the vibration of the drum 5 or the tub 4 is transmitted to the drawer 3, noise or vibration due to collision between the drawer 3 and the cabinet 1 is generated, and the possibility that the drawer 3 is ejected from the cabinet 1 during the operation of the driving part may not be excluded.

In order to minimize the problem, the laundry treatment apparatus 100 may include a drawer holder locking the drawer 3 to the cabinet 1. The drawer holder may be provided to fasten the drawer panel 37 to the front panel 11 when the drawer panel 37 closes the opening 111.

Figure 3:
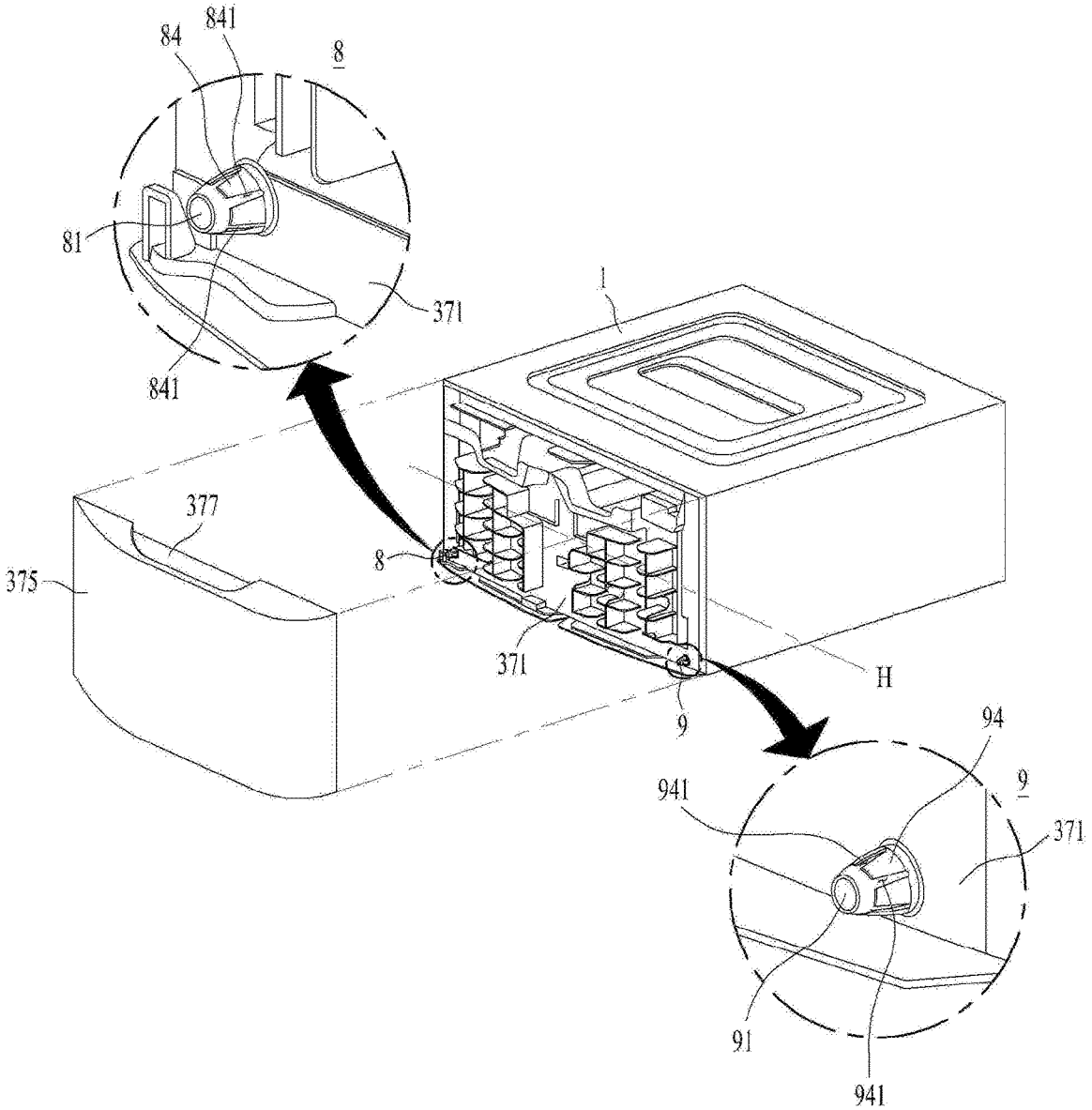
FIG. 3 is a view showing an embodiment of a drawer holder provided in the laundry treatment apparatus.

As shown in FIG. 3, the drawer holder 8, 9 may be provided to include at least one of a first holder 8 positioned in the left side of the opening 111 and a second holder 9 positioned in the right side of the opening 111. The first holder 8 and the second holder 9 are preferably positioned below a horizontal line H passing through the center of the opening 111. Since the driving part 57, 58, 59 causing vibration is provided in a lower area (an area positioned below the horizontal line) of the drawer body 31, when the holders 8 and 9 are positioned below the horizontal line H, the vibration of the drawer may be efficiently reduced.

The first holder 8 may include: a fastening body 81 (a first fastening body) protruding from a left area of the opening 111 in the front panel 11 toward the panel body 371; a panel through hole 82 (a first panel through hole, referring to FIG. 1) provided in the panel body 371 and into which the fastening body 81 is inserted; a receiving body 84 (a first receiving body) fixed to the panel body 371 and providing a space in which the fastening body 81 inserted in the panel through hole 82 is received; and a cut portion 841 (first cut portion) dividing the first receiving body 84 into a plurality of boards that are separated from each other. The first cut portion 841 may extend from a free end of the first receiving body 84 toward the panel body 371, and include a plurality of cut grooves penetrating through the first receiving body 84.

The first receiving body 84 may be formed in one of a cylindrical shape with an empty inside, a conical shape with an empty inside, a polygonal pillar shape with an empty inside, and a polygonal pyramid shape with an empty inside. The first fastening body 81 may be formed in a shape that may be forcibly fitted in the first receiving body 84 (the shape corresponding to the first fastening body). FIG. 3 is a view showing the first receiving body 84 formed in a conical shape with an empty inside and the first fastening body 81 formed in a conical shape.

Likewise, the second holder 9 may include: a second fastening body 91 protruding from a right area of the opening 111 in the front panel 11 toward the panel body 371; a second panel through hole (not shown) provided in the panel body 371 and into which the second fastening body 91 is inserted; a second receiving body 94 fixed to the panel body 371 and providing a space in which the second fastening body 91 inserted in the second panel through hole is received; and a second cut portion 941 dividing the second receiving body 94 into a plurality of boards that are separated from each other. The second cut portion 941 may extend from a free end of the second receiving body 94 toward the panel body 371, and include a plurality of cut grooves penetrating through the second receiving body 94.

Also, the second receiving body 94 may be formed in one of a cylindrical shape with an empty inside, a conical shape with an empty inside, a polygonal pillar shape with an empty inside, and a polygonal pyramid shape with an empty inside. The second fastening body 91 may be formed in a shape that is forcibly fitted in the second receiving body 94.

When the drawer panel 37 closes the opening 111, the first fastening body is forcibly fitted in the first receiving body 84 and the second fastening body 91 is forcibly fitted in the second receiving body 94. Accordingly, the drawer holders 8 and 9 may minimize the risk that the drawer 3 is ejected from the cabinet 1 by vibration.

Meanwhile, in the drawer holder 8, 9 having the above-described structure, when external force is applied to the cabinet 1 or the drawer panel 37, one of the fastening bodies 81 and 91 and the receiving bodies 84 and 94 may be damaged. In other words, when the cabinet 1 and the drawer panel 37 move relative to each other, the fastening bodies 81 and 91 and the receiving bodies 84 and 94 also move relative to each other, and in this process, the fastening bodies 81 and 91 and the receiving bodies 84 and 94 may be damaged.

In order to solve the above problem, the laundry treatment apparatus 100 may have a board supporter limiting displacement of the receiving body 84, 94. The board supporter may include a board supporter (a first board supporter) provided in the first holder 8, and a board supporter (a second board supporter) provided in the second holder 9.

Figure 4:
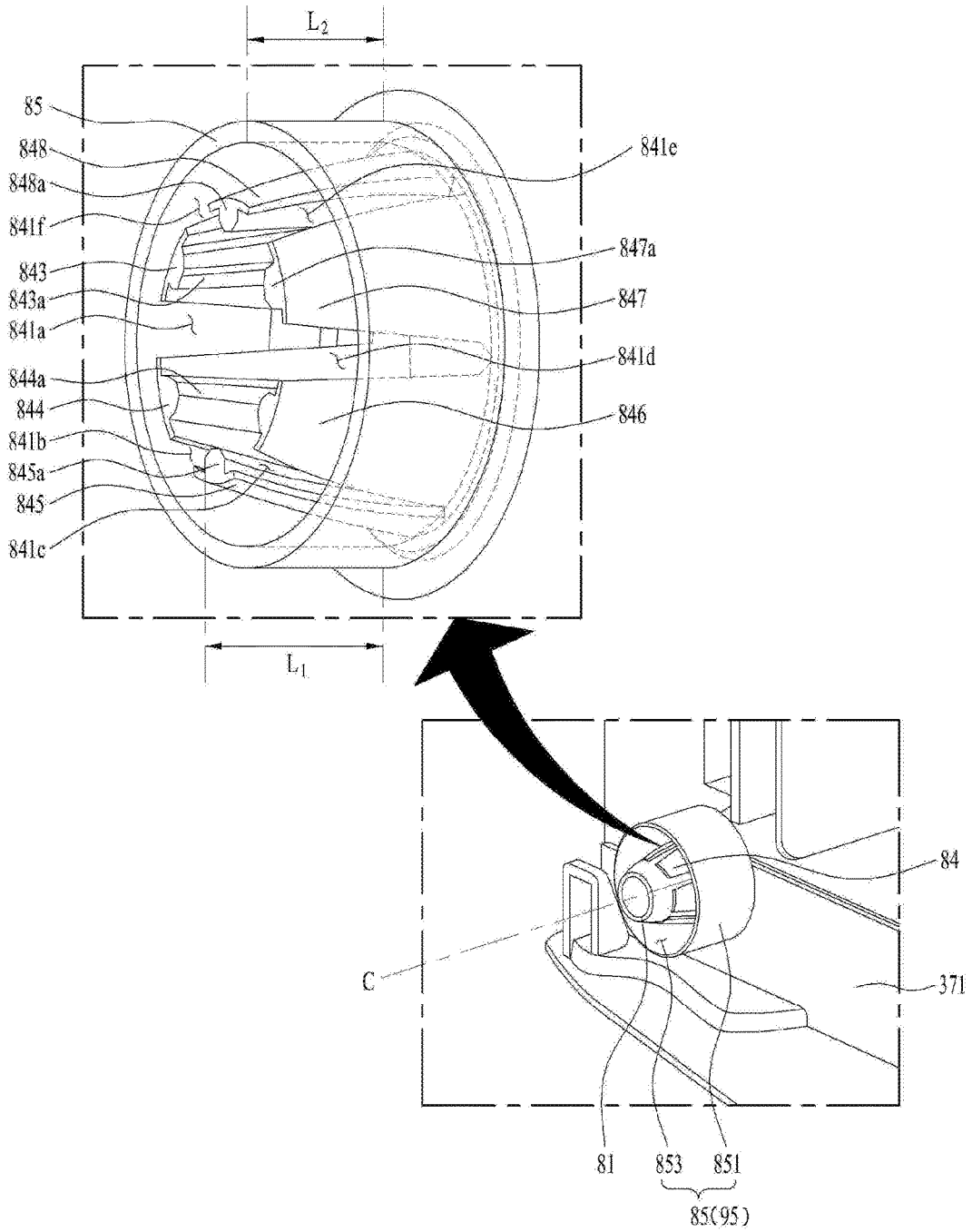
FIG. 4 is a view showing another embodiment of the drawer holder provided in the laundry treatment apparatus.

FIG. 4 is a view showing an embodiment of the first board supporter 85. As previously described, the first receiving body 84 has the first cut portion 841, and the first receiving body 84 has at least two separate boards by the first cut portion 841. In the embodiment shown in FIG. 4, the first cut portion 841 includes six cut grooves 841*a*, 841*b*, 841*c*, 841*d*, 841*e*, and 841*f*, so the first receiving body 84 has six boards 843, 844, 845, 846, 847, and 848.

That is, the first cut portion 841 may include a first cut groove 841*a*, a second cut groove 841*b*, a third cut groove 841*c*, a fourth cut groove 841*d*, a fifth cut groove 841*e*, and a sixth cut groove 841*f* that extend from the free end of the first receiving body 84 toward the panel body 371. In this case, the first receiving body 84 may have a first board 843, a second board 844, a third board 845, the fourth board 846, a fifth board 847, and a sixth board 848 that are separated from each other by the cut grooves.

The first board supporter 85 may be configured to limit a motion range of the board 843, 844, 845, 846, 847, 848 that may move in a direction radially away from the center C of the first panel through hole 82. In the embodiment shown in FIG. 4, the first board supporter 85 is formed in a pipe shape covering the first receiving body 84. In other words, the first board supporter 85 of FIG. 4 may include a cylinder-shaped support body 851 (a first support body) fixed to the panel body 371 and a body through hole 853 (a first body through hole) provided by penetrating through the support body 851 and in which the first fastening body 81 is inserted.

A distance between the first board supporter 85 and the boards 843, 844, 845, 846, 847, and 848 is preset to be shorter than a displacement by which plastic deformation occurs in the boards 843, 844, 845, 846, 847, and 848. Accordingly, even when the first fastening body 81 and the first receiving body 84 move relative to each other, the laundry treatment apparatus 100 according to the embodiment of FIG. 4 is configured such that the boards 843, 844, 845, 846, 847, and 848 are elastically defamed within elastic limits, so that damage to the first fastening body 81 or the first receiving body 84 may be minimized.

In order to minimize the plastic deformation of the boards 843, 844, 845, 846, 847, and 848, a length L2 from the panel body 371 to a free end of the first board supporter 85 is preferably preset to be longer than a length L1 from the panel body 371 to the free end of the first receiving body 84. Although not shown in the drawings, the length L2 from the panel body 371 to the free end of the first board supporter 85 may be preset to be longer than ½ of the length L1 from the panel body 371 to the free end of the first receiving body 84.

In order to increase fastening force between the first fastening body 81 and the first receiving body 84, the boars may have contact protrusions that protrude toward the inside of the first receiving body 84. In other words, the first board 843, the second board 844, the third board 845, the fourth board 846, the fifth board 847, and the sixth board 848 may respectively have a first contact protrusion 843*a*, a second contact protrusion 844*a*, a third contact protrusion 845*a*, a fourth contact protrusion 846*a*, a fifth contact protrusion 847*a*, and a sixth contact protrusion 848*a* that protrude toward the inside of the first receiving body 84.

The second board supporter 95 provided in the second holder 9 may be configured to have the same structure as the structure of the first board supporter 85, so the detailed description thereof will be omitted.

Figure 5:
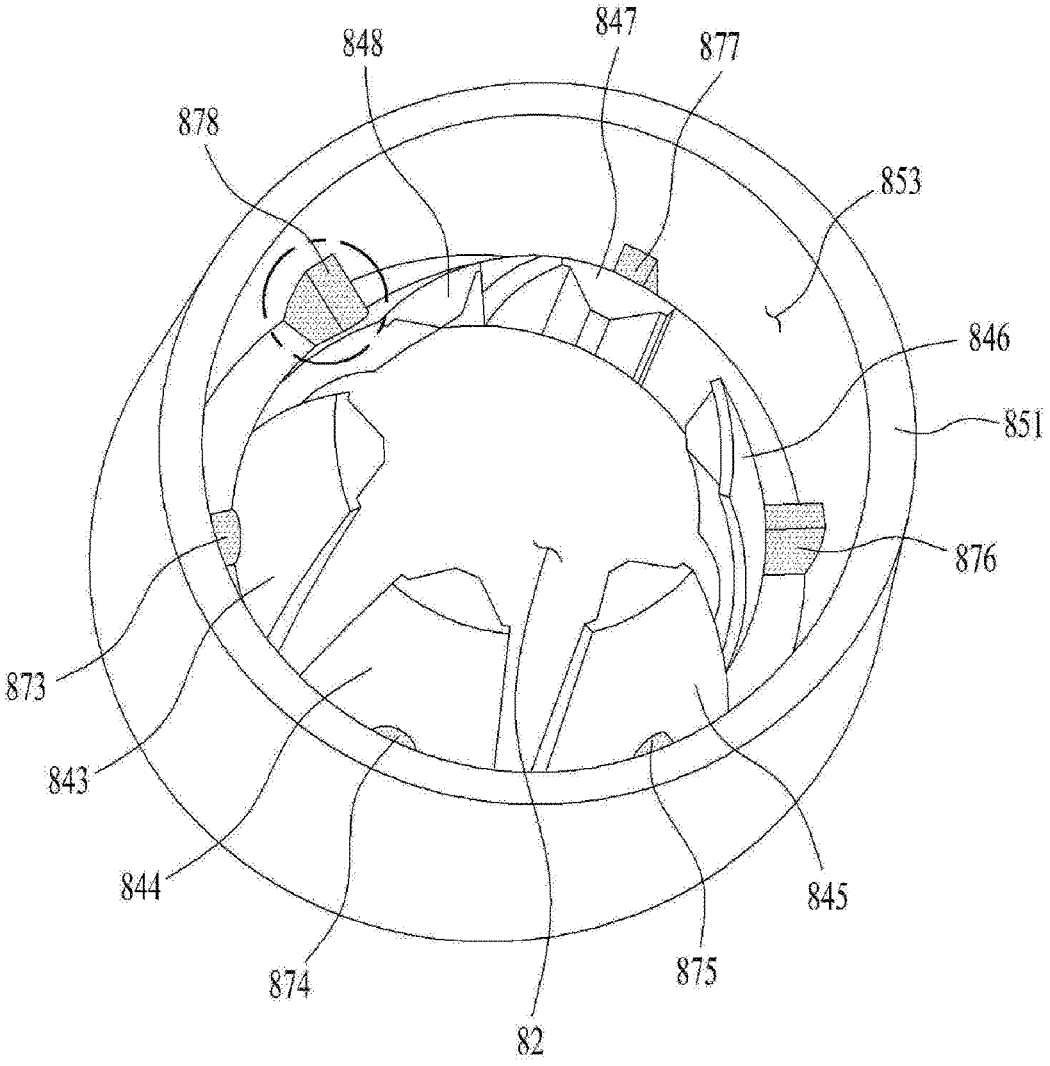
FIGS. 5 and 6 are views showing further embodiments of the drawer holder provided in the laundry treatment apparatus.

FIG. 5 is a view showing another embodiment of the first board supporter 85. In the first board supporter 85 according to the embodiment of FIG. 5, the board 843, 844, 845, 846, 847, 848 is connected to the first support body 851 through a reinforcing portion (a first reinforcing portion). The first reinforcing portion is a means that connects an outer circumferential surface of the board to an inner circumferential surface of the first support body 851 (or connects outer circumferential surface of the board, an inner circumferential surface of the first support body, and the panel body of the drawer panel to each other) to reinforce the strength of the board 843, 844, 845, 846, 847, 848. The number of the first reinforcing portion is provided in the same number as the number of the boards.

In the embodiment of FIG. 5, the first reinforcing portion includes: a first connection part 873 connecting the first board 843 to the first support body 851, a second connection part 874 connecting the second board 844 to the first support body 851, a third connection part 875 connecting the third board 845 to the first support body 851, a fourth connection part 876 connecting the fourth board 846 to the first support body 851, a fifth connection part 877 connecting the fifth board 847 to the first support body 851, and a sixth connection part 878 connecting the sixth board 848 to the first support body 851.

In the above structure, a distance between the panel body 371 and a free end of the reinforcing portion 873, 874, 875, 876, 877, 878 is preferably preset to be shorter than a distance between the panel body 371 and a free end of the board 843, 844, 845, 846, 847, 848. When a length of the reinforcing portion 873, 874, 875, 876, 877, 878 is preset to be equal to a length of the board 843, 844, 845, 846, 847, 848 (when a length of the reinforcing portion is preset to be longer than ½ of a length of the board), the function of absorbing external force decreases as the board is elastically deformed (the defamation of the board is limited by the reinforcing portion thereby increasing the possibility that the board is easily broken).

The second holder 9 may also include the reinforcing portion (a second reinforcing portion), and the second reinforcing portion is configured to have the same structure as the structure of the first reinforcing portion, so the detailed description thereof will be omitted.

Figure 6:
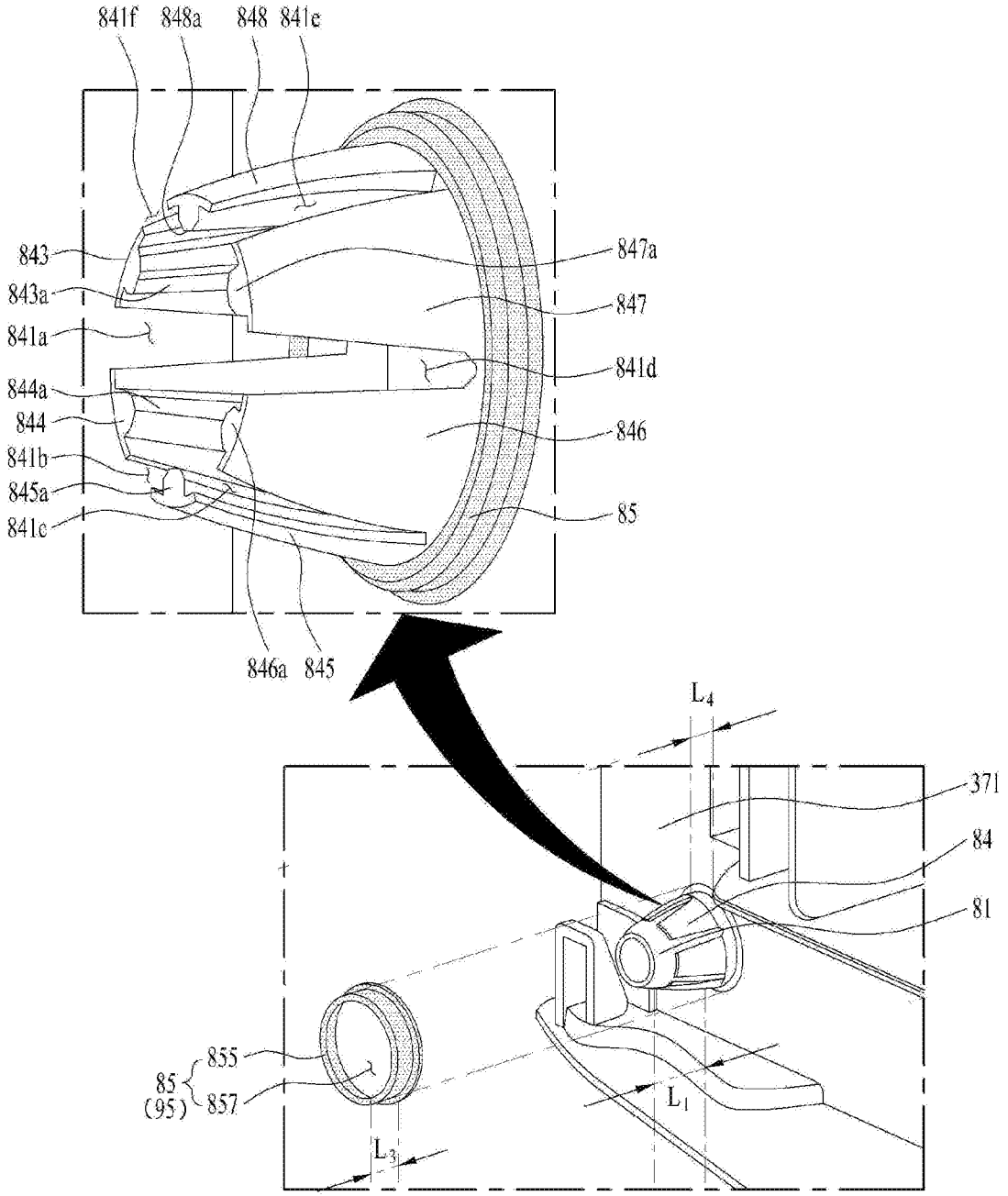

FIG. 6 is a view showing a still another embodiment of the first board supporter 85. The first board supporter 85 according to the embodiment of FIG. 6 is formed in a ring shape that is removably locked to a circumferential surface of the first receiving body 84. In other words, the first board supporter 85 according to this embodiment includes a cylindrical support body 855 (a second support body) and a body through hole 857 (a second body through hole) penetrating the second support body and in which the first fastening body 81 is inserted.

When the first board supporter 85 is formed in the ring shape that is removably locked to the circumferential surface of the first fastening body 81, a length L3 from the panel body 371 to the free end of the first board supporter 85 is preferably preset to be less than ½ of a length L1 from the panel body 371 to the free end of the first receiving body 84. The above structure is provided to prevent plastic deformation of the board 843, 844, 845, 846, 847, 848 while allowing elastic deformation of the board 843, 844, 845, 846, 847, 848.

In the embodiment of FIG. 6, the length L3 from the panel body 371 to the free end of the first board supporter 85 is preset to be longer than a length L4 from the panel body 371 to an end of the first cut portion 841.

Also, the second holder 9 may include the second board supporter 95 having the structure shown in FIG. 6, and the second board supporter 95 may be configured to have the same structure as the structure of the first board supporter 85, so the detailed description thereof will be omitted.

In the embodiment, the fastening body 81, 91 is provided in the front panel 11 and the panel through hole 82 and the receiving body 84, 94 are provided in the panel body 371, but the fastening body 81, 91 may be provided in the panel body 371 and the panel through hole 82 and the receiving body 84, 94 may be provided in the front panel 11.

In other words, the drawer holder 8, 9 may include: the fastening body 81, 91 protruding from the panel body 371 toward the front panel 11; the panel through hole 82 provided in the front panel 11; the cylindrical receiving body 84, 94 fixed to the front panel 11 and providing the space in which the fastening body 81, 91 inserted in the panel through hole 82 is received; the cut portion 841, 941 provided by penetrating through the receiving body 84, 94 and dividing the receiving body into at least two separate boards; and the board supporter 85, 95 limiting the motion range of the board in the direction away from the center of the panel through hole 82, 92.

Although the preferred embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A laundry treatment apparatus comprising:

a cabinet comprising a front panel and an opening provided by penetrating through the front panel;

a drawer body configured to be ejected from and retracted into the cabinet through the opening of the cabinet;

a tub provided in the drawer body and defining a space configured to receive water;

a drum rotatably provided in the tub and configured to receive laundry;

a drawer panel fixed to the drawer body and configured to open the opening of the cabinet when the drawer body is ejected from the cabinet and to close the opening of the cabinet when the drawer body is retracted into the cabinet; and a drawer holder configured to fasten the drawer panel to the cabinet when the drawer panel closes the opening of the cabinet, wherein the drawer holder comprises:

a fastening body protruding from the front panel toward the drawer panel;

a panel through hole formed in a portion of the drawer panel, the portion facing the front panel, and into which the fastening body is inserted;

a receiving body fixed to the drawer panel and providing a space for receiving the fastening body inserted in the panel through hole;

a cut portion extending from a free end of the receiving body toward the drawer panel and provided by penetrating through the receiving body, and dividing the receiving body into at least two boards that are separated from each other; and a board supporter limiting a motion range of each of the boards in a direction away from a center of the panel through hole.

2. The laundry treatment apparatus of claim 1, wherein a distance between the board supporter and each of the boards is preset to be shorter than a displacement by which the board performs plastic deformation.

3. The laundry treatment apparatus of claim 2, wherein the board supporter comprises a support body fixed to the drawer panel and covering the receiving body.

4. The laundry treatment apparatus of claim 3, further comprising:

a reinforcing portion provided to connect an outer circumferential surface of the board to the support body to reinforce strength of the board.

5. The laundry treatment apparatus of claim 3, further comprising:

a reinforcing portion provided to connect an outer circumferential surface of the board, the drawer panel, and the support body to each other, wherein a length from the drawer panel to a free end of the reinforcing portion is preset to be shorter than a length from the drawer panel to a free end of the board.

6. The laundry treatment apparatus of claim 3, wherein a length from the drawer panel to a free end of the support body is preset to be equal to or longer than a length from the drawer panel to the free end of the receiving body.

7. The laundry treatment apparatus of claim 2, wherein the receiving body is configured as one of a cylindrical shape with an empty inside, a conical shape with an empty inside, a polygonal pillar shape with an empty inside, and a polygonal pyramid shape with an empty inside.

8. The laundry treatment apparatus of claim 2, wherein the board supporter comprises a ring-shaped support body removably locked to a circumferential surface of the receiving body.

9. The laundry treatment apparatus of claim 8, wherein a length from the drawer panel to a free end of the support body is preset to be longer than a length from the drawer panel to an end of the cut portion.

10. The laundry treatment apparatus of any one of claims 1 to 9, further comprising:

a contact protrusion protruding from each of the boards toward an inside of the receiving body to be in contact with the fastening body.

11. The laundry treatment apparatus of any one of claims 1 to 9, wherein the drawer holder comprises:

a first holder positioned on the cabinet at a left side of the opening; and a second holder positioned on the cabinet at a right side of the opening.

12. The laundry treatment apparatus of claim 11, further comprising:

a tub entrance provided by penetrating through an upper surface of the tub;

a drum entrance provided by penetrating through an upper surface of the drum;

a stator fixed to a bottom surface of the tub and generating a rotating magnetic field;

a rotor rotated by the rotating magnetic field; and a rotating shaft provided by penetrating through the bottom surface of the tub to connect the rotor to the drum, wherein the first holder and the second holder are positioned below a horizontal line passing through a center of the opening of the cabinet.

13. A laundry treatment apparatus comprising:

a cabinet comprising a front panel and an opening provided by penetrating through the front panel;

a drawer body configured to be ejected from and retracted into the cabinet through the opening of the cabinet;

a tub provided in the drawer body and defining a space configured to receive water;

a drum rotatably provided in the tub and configured to receive laundry;

a drawer panel fixed to the drawer body and configured to open the opening of the cabinet when the drawer body is ejected from the cabinet and to close the opening of the cabinet when the drawer body is retracted into the cabinet; and a drawer holder locking the drawer panel to the cabinet when the drawer panel closes the opening of the cabinet, wherein the drawer holder comprises:

a fastening body protruding from the drawer panel toward the front panel;

a panel through hole provided by penetrating through the front panel and into which the fastening body is inserted;

a receiving body fixed to the front panel and providing a space in which the fastening body inserted in the panel through hole is received;

a cut portion provided by penetrating through the receiving body, extending from a free end of the receiving body toward the front panel, and dividing the receiving body into at least two boards that are separated from each other; and a board supporter limiting a motion range of each of the boards in a direction radially away from a center of the panel through hole.

14. The laundry treatment apparatus of claim 11, wherein a distance between the board supporter and each of the boards is preset to be shorter than a displacement by which the board performs plastic deformation.

* * * * *